United States Patent [19]

Garnes

[11] Patent Number: 5,013,042

[45] Date of Patent: May 7, 1991

[54] GOLF PUTTING PRACTICE DEVICE

[76] Inventor: Joseph Garnes, 18307 Puritas Ave., Cleveland, Ohio 44135

[21] Appl. No.: 554,718

[22] Filed: Jul. 18, 1990

[51] Int. Cl.[5] ..... A63B 69/36

[52] U.S. Cl. ..... 273/184 A; 273/177 R; 273/33; 273/183 C

[58] Field of Search ..... 273/177 R, 184 R, 184 A, 273/185 R, 185 A, 183 R, 183 A, 183 C, 183 E

[56] References Cited

U.S. PATENT DOCUMENTS

| | | | |
|---|---|---|---|
| 3,048,405 | 8/1962 | McCaul | 273/177 R |
| 4,106,772 | 8/1978 | Krawagna | 273/186 R |
| 4,133,534 | 1/1979 | Ikemoto | 273/184 A |
| 4,560,167 | 12/1985 | Perreau | 273/184 A |
| 4,936,583 | 6/1990 | Peabody et al. | 273/177 R |

*Primary Examiner*—George J. Marlo
*Attorney, Agent, or Firm*—J. Helen Slough

[57] ABSTRACT

The present invention is a disc with means for seating a golf ball which in the preferred embodiment is a small hole in the center of the disc. In use, one lays the disc down on the ground surface and places a golf ball in the center of the disc. Then a second ball is selectively positioned at a distance from the disc and the said latter ball putted toward the disc. A player is informed that his putted golf ball would enter a hole on a conventional green when the ball putted rides over the edge of the disc and contacts the golf ball seated in the center of the same.

3 Claims, 1 Drawing Sheet

GOLF PUTTING PRACTICE DEVICE

FIELD OF THE INVENTION

This invention relates to golf practice devices and is particularly related to putting and practice putting devices.

BACKGROUND OF THE INVENTION

Various methods of practice putting at a hole has been known in the previous art. Certain of these involve the placement of ball receivers of metal, ceramic, and the like, and directing a golf ball by means of a putter at the receiver. Other more sophisticated forms involve the use of an electrical device which can return a ball putted at the same. One of the problems involved in the use of these and other devices of said type is that the devices do not in actuality present a hole as in the green on a golf course. In most of the devices in the prior art the bail must be putted up and over an incline or lip to reach the hole. Also these devices are hard to carry when one travels. Many of these devices that do come close to simulating the hole are expensive to make and purchase. Thus, the object of this invention is to produce a simulated golf hole for practice putting on a carpet or lawn ground or the like and which accurately represents an official regulation golf hole on a real green and presents the same difficulties as when putting into a hole on a green. It is light-weight and convenient to carry and is inexpensive in manufacture.

SUMMARY OF THE INVENTION

A relatively fiat circular disc is provided having an outer circumference identical to the outer circumference of a hole on a green on a conventional golf course. The disc is provided with an opening for seating a golf ball in the center of the disc. In use a player places the disc face down on flooring, a ground surface, carpeting, or like foundation viz. wherever the player wishes to establish a putting green, and seats a golf ball in the center of the disc. The player then sets a second golf ball at any preferred distance from the hole represented by the disc and proceeds to putt the said second golf ball toward the disc, which from his putting stance has the appearance of a golf hole. When the player putting puts his ball in motion, the ball if properly directed passes over the outer edge of the disc and touches the golf ball in the center and the player is assured that the ball if so putted in actual play from the same distance and direction would drop into a hole on the green in the location of the disc.

DETAILED DESCRIPTION OF THE PREFERRED EMBODIMENT

Figure 1:
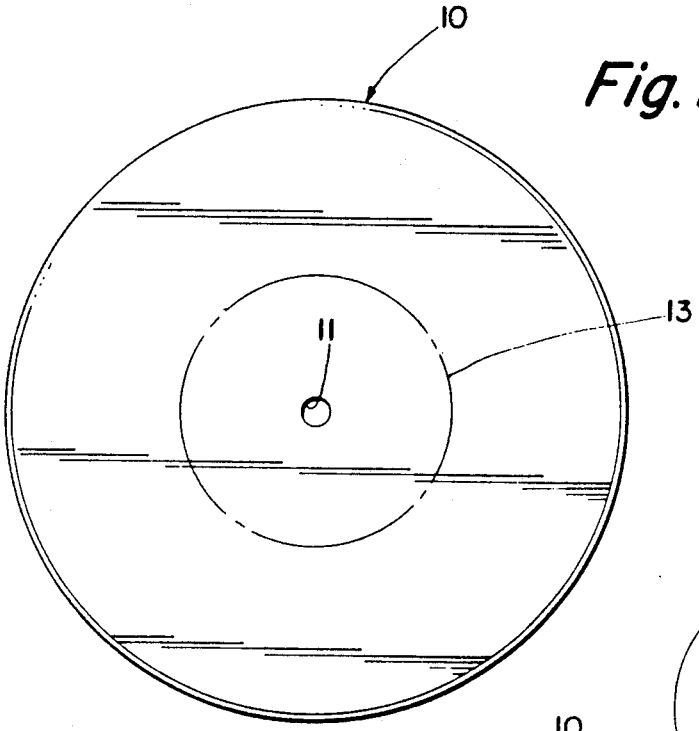
FIG. 1: is a top view of the device of the golf practice device of the invention.

Reference is now made to the Figures, in all of which like parts are designated by like reference numbers, in FIG. 1, a disc 10 of plastic, cardboard, or other material is shown having the outer circumference of a hole on the green of a conventional golf course. The disc preferably is provided with means 11, which as shown is a small opening in the center of the disc for seating a golf ball on the center of the disc. The disc is four inches in diameter which is the exact size of a conventional golf ball hole and 1/16 of an inch thick. It is light weight and of an size whereby it can easily be fitted into an individuals' shirt pocket.

Figure 2:
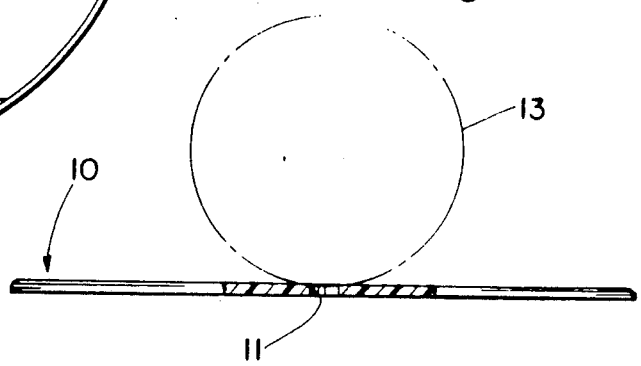
FIG. 2: is an end view of the device of FIG. 1.
Figure 3:
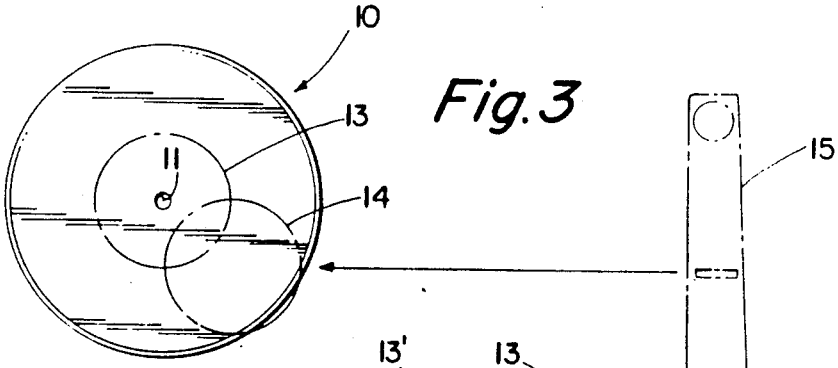
FIG. 3: is a perspective view of the device of FIGS. 1 and 2 showing a ball placed on the disc and shows a putted ball in contact with the ball shown in FIGS. 1 and 2.
Figure 4:
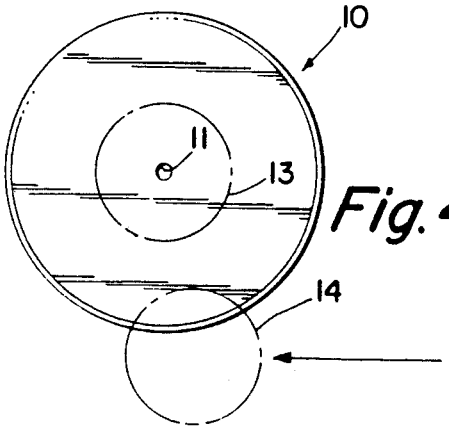
FIG. 4: is a top view of the disc of FIGS. 1 and 2 inclusive showing a putted ball adjacent the disc.
Figure 5:
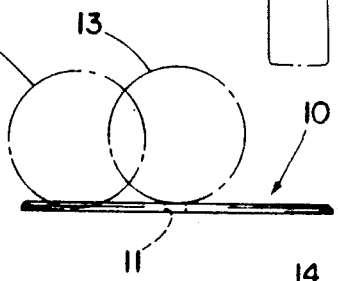
FIG. 5: is an end view showing putted ball in the final position of FIG. 3.
Figure 6:
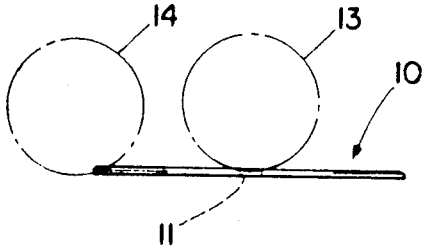
FIG. 6: is an end view showing a putted ball in the final putted position shown in FIG. 4.

FIG. 2 discloses a golf ball placed on the disc of FIG. 1 and in a position upon ground or the like of preparation for use of the putting device 10 for practice putting. The practice is initiated by placing the said first golf ball 13 in the opening 11 in the center of the disc 10. The player then steps back a selected distance from the hole and places a second golf ball 14 which he wishes to putt on the floor or other ground surface and strikes the said second ball with a putter 15 putting the ball towards the disc on which the ball 13 is seated in the center opening 11. If the second golf ball 14 when struck travels to the disc and if it hits the ball seated in the center hole 11 the player knows that if the disc were a hole on a green he would have dropped the ball into the hole since over half of the second ball putted would have traveled in such case over the rim of the hole and therefore would have fallen into the hole.

The invention actually simulates the act of putting on a real green in that the disc which one is putting at is the exact size of an actual hole, and provides means which can determine whether the ball which was hit went into the hole or not.

Although one embodiment of this invention has been illustrated and described, it is to be understood by one skilled in the art that numerous and extensive changes and modifications can be carried out in this invention shown and described without departing from the spirit and scope of the claimed invention. Accordingly, the scope of the invention is intended to be limited only by the scope of the appended claims.

What is claimed is:

1. A practice putting device comprising:

first and second golf balls of essentially the same diameter, a disc for simulating a conventional golf hole, said disc having a centrally located means for seating a golf ball, said first golf ball being seated on said seating means, the relative sizes of said disc and balls being such that when said seated ball is contacted by said second golf ball when putted at said seated ball, the golfer knows that said second ball would have entered said conventional golf hole since over half of the second ball would have traveled over the rim of the conventional hole.

2. A practice putting device as in claim 1 wherein: the same is a flat planular disc and affords horizontal access to a designated hole area.

3. A practice putting device as in claim 1 wherein: the central seating means is an opening in the center of the disc.

* * * * *

UNITED STATES PATENT AND TRADEMARK OFFICE

CERTIFICATE OF CORRECTION

PATENT NO. : 5,013,042

DATED : May 7, 1991

INVENTOR(S) : Joseph Garnes

It is certified that error appears in the above-identified patent and that said Letters Patent is hereby corrected as shown below:

Column 1, Line 21, change "bail" to --ball--.

Column 1, Line 35, change "fiat" to --flat--.

Signed and Sealed this

Eighth Day of September, 1992

*Attest:*

DOUGLAS B. COMER

*Attesting Officer*

*Acting Commissioner of Patents and Trademarks*